US005971220A

United States Patent [19]

Payne

[11] Patent Number: 5,971,220

[45] Date of Patent: Oct. 26, 1999

[54] WATER DISPENSER APPARATUS AND METHOD

[76] Inventor: Ernest F. Payne, 2445 SW. 18th Ter., #403, Fort Lauderdale, Fla. 33315

[21] Appl. No.: 09/060,376

[22] Filed: Apr. 15, 1998

[51] Int. Cl.[6] ..... B67D 5/06; B65B 1/04

[52] U.S. Cl. ..... 222/185.1; 222/1; 141/290; 141/364; 141/391

[58] Field of Search ..... 222/180, 181.1, 222/185.1, 186, 481, 501, 1; 141/391, 351, 364, 1, 290

[56] References Cited

U.S. PATENT DOCUMENTS

| | | | |
|---|---|---|---|
| 568,921 | 10/1896 | Pokrantz | 1/1 |
| 3,198,395 | 8/1965 | McKinney | 222/185.1 |
| 3,536,107 | 10/1970 | Schreiber | 141/18 |
| 3,974,863 | 8/1976 | Frahm | 141/18 |
| 5,048,723 | 9/1991 | Seymour | 222/81 |
| 5,121,778 | 6/1992 | Baker | 141/319 |
| 5,405,058 | 4/1995 | Kalis et al. | 222/185 |
| 5,406,996 | 4/1995 | Wagner et al. | 141/364 |
| 5,439,145 | 8/1995 | Salkeld | 222/189 |
| 5,586,692 | 12/1996 | Livengood | 222/166 |
| 5,732,857 | 3/1998 | Yared | 222/185.1 |

*Primary Examiner*—Andres Kashnikow
*Assistant Examiner*—Keats Quinalty
*Attorney, Agent, or Firm*—Alvin S. Blum

[57] ABSTRACT

A dispensing apparatus clamps onto the neck of a large liquid container such as a pure water bottle, sealing the mouth of the container, while the bottle is upright. The apparatus has an elongate column upstanding from a broad base. A passage at the top of the column receives the bottle neck and clamps the apparatus onto the bottle while sealing the mouth. The bottle is then tilted onto its side and then pivoted on the base until the bottle is inverted. A vent tube with check valve extends up through the seal and to the bottom of the bottle. A dispensing tube with valve extends down through the seal and terminates in a dispensing valve. The problems of spilling and injury from lifting and inverting are avoided.

12 Claims, 3 Drawing Sheets

WATER DISPENSER APPARATUS AND METHOD

BACKGROUND OF THE INVENTION

This invention relates to liquid dispensers, and more particularly to an inverted water bottle support and dispenser and a method for mounting the bottle with reduced effort.

Supports and dispensers for water bottles, as exemplified by U.S. Pat. No. 5,121,778 issued Jun. 16, 1992 to Baker et al. consider problems associated with fluid spilling while inverting the bottle and while removing a partially empty inverted bottle. None of the prior art resolve the serious problems of lifting and inverting a large, difficult to hold, container with serious strain and injury. They have considered various solutions to the spilling problem including never inverting the bottle, but pumping or syphoning out the liquid. It would be useful to have a system that would permit gravity dispensing from an inverted bottle that would overcome both the lifting problem and the spilling problem.

SUMMARY OF THE INVENTION

It is accordingly an object of the invention to provide apparatus and method for lifting and inverting a large water bottle to a gravity dispensing condition that greatly reduced the lifting effort and that eliminated the spilling problem in a safe, simple and inexpensive manner.

The apparatus of the invention comprises a stand with a broad base. Upstanding from the base is a tubular column. Near the top of the column is a transverse septum topped by a resilient gasket. The top of the column is dimensioned to receive the neck of the bottle. Locking means attached to the column engage the bottle neck and hold it down tightly and sealingly force the bottle mouth against the resilient gasket. Passing through the septum are two tubes. The first tube extends upwardly to a distance almost equal to the bottle height. It is topped by a check valve to permit fluid to pass from the tube through the valve. The second tube passes downward from the septum and then sideward through the side of the column where it terminates in a valve for dispensing the liquid when the bottle is inverted and the neck is clamped in the top of the column. The method of use of the apparatus is as follows:

The bottle, with neck uppermost is uncapped.

The apparatus is inverted and the column is passed over the bottle neck until the septum rests against the bottle mouth with the check valve close to the bottom of the bottle. The bottle is then clamped in place.

The assembly is then tilted until the bottle is on its side and an edge of the base is resting on a support surface. The bottom of the bottle is then raised while the assembly pivots on the edge of the base, taking most of the weight, until the column is vertical and the bottle inverted without spilling any fluid because the bottle has been sealed throughout the process.

These and other objects, features and advantages of the invention will become more apparent when the detailed description is studied in conjunction with the drawings, in which like reference characters designate like elements in the various drawing figures.

DETAILED DESCRIPTION OF PREFERRED EMBODIMENTS

Figure 4:
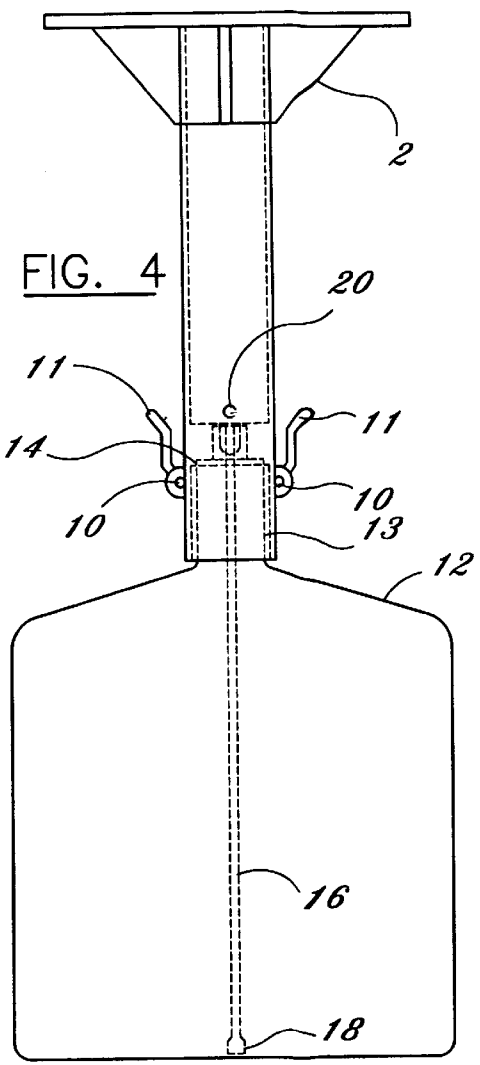
FIG. 4 is a side view of the apparatus as in FIG. 1, shown in position for clamping onto the upright container.
Figure 2:
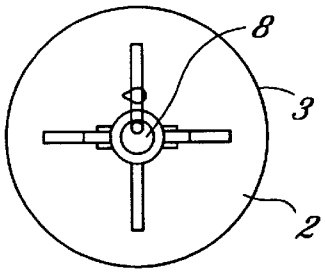
FIG. 2 is a top view of the apparatus of FIG. 1.
Figure 3:
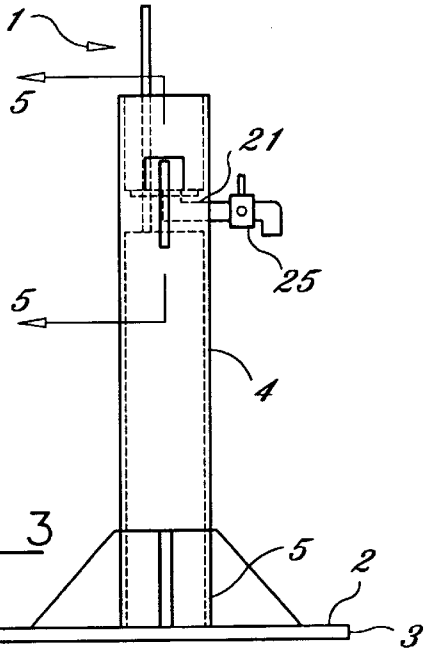
FIG. 3 is a side view of the apparatus of FIG. 1 that has been rotated 90°.
Figure 1:
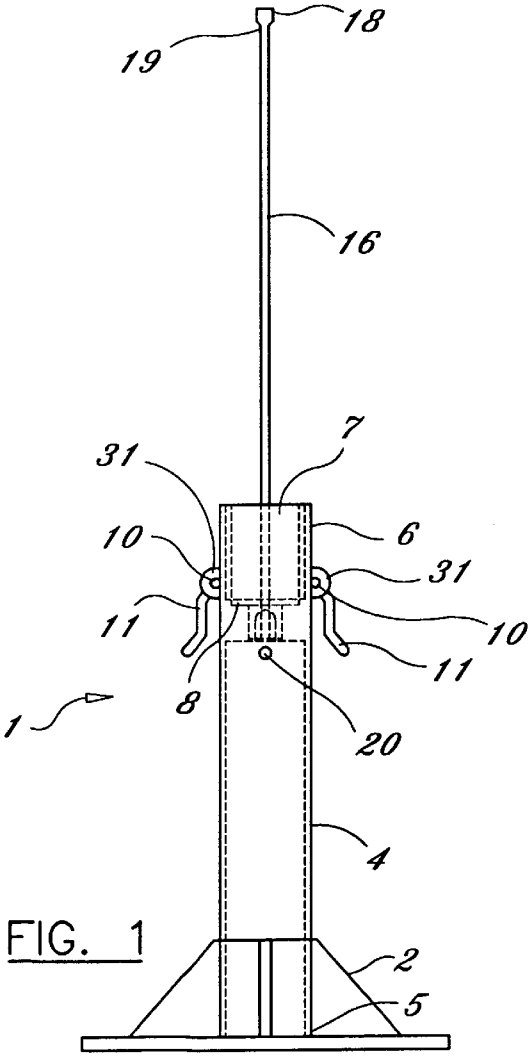
FIG. 1 is a side elevation view of the apparatus of the invention.

Referring now first to FIGS. 1–5, a first embodiment of the apparatus 1 of the invention comprises a broad base 2 with outer edge 3. The base being wide enough to prevent the container 12 from tipping. An elongate column 4 affixed to base 2 at a first end 5 is upstanding from the base to a free second end 6 that is provided with a passage 7 that is dimensioned to receive therein the neck 13 of the container 12. A transverse barrier 8 affixed to the bottom of passage 7 is provided with a resilient sealing means or gasket 9 that may be made of silicone rubber, for example, that sealingly engages the mouth 14 of the container. The weight of the apparatus is sufficient force on the gasket to achieve sealing when the container is upright and the apparatus is mounted thereon, and the 40+pounds of the filled container is great sealing force when it is inverted. A system for clamping the apparatus onto the neck of the container includes two cam levers 11 pivotally mounted on shafts 10 that are supported on the column by cam pivot supports 31. When the cam levers are rotated upward from the position shown in FIG. 1, the cams are forced against the neck and secure the mouth of the container sealingly on the gasket. An elongate vent tube 16 has a first terminus 17 passing through the seal 9 and barrier 8 to pass air from air hole 20 through the vent tube and up through the one way check valve 18 well known in the art that is close to the bottom of the container as water is dispensed to prevent a vacuum from forming. The valve 18 prevents the loss of water when the container is inverted. A dispensing tube 21 has a first end 22 that passes up through the barrier and gasket to be in fluid connection with the mouth of the container. Tube 21 extends downwardly and out the side to terminate in dispensing valve 25 to controllably dispense liquid under gravity flow as required. When the apparatus is clamped on the upright container after removing any cover cap, the assembly is pivoted on the container bottom until it lies on its side. Then the container is lifted and pivoted on the edge 3 of the base until the container is inverted and the assembly rests on the base 2 ready for use.

Figure 5:
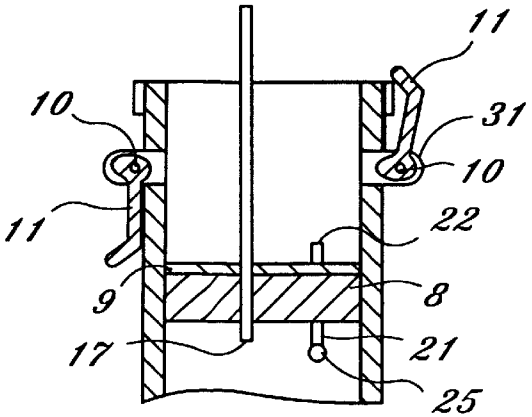
FIG. 5 is a sectional detail taken through line 5—5 of FIG. 3.

FIG. 5 shows the left cam lever in the unlocked position and the right cam lever in the locked position.

Figure 6:
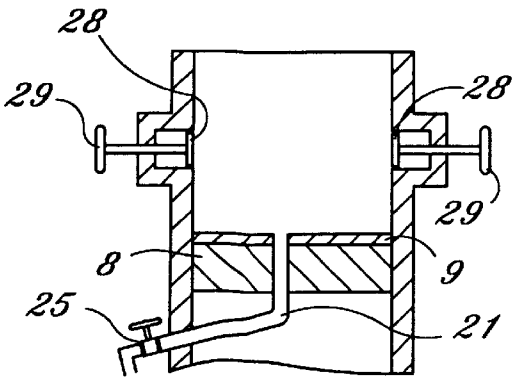
FIG. 6 is a sectional view as in FIG. 6 of another embodiment with threaded clamping means.
Figure 10:
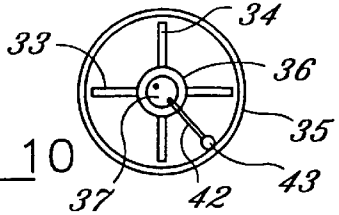
FIG. 10 is a top view of the apparatus of FIG. 7.

Referring now to FIG. 6, the alternative clamping means comprises a rubber covered clamping element 28 that is advanced by threaded thumb screw 29.

Figure 7:
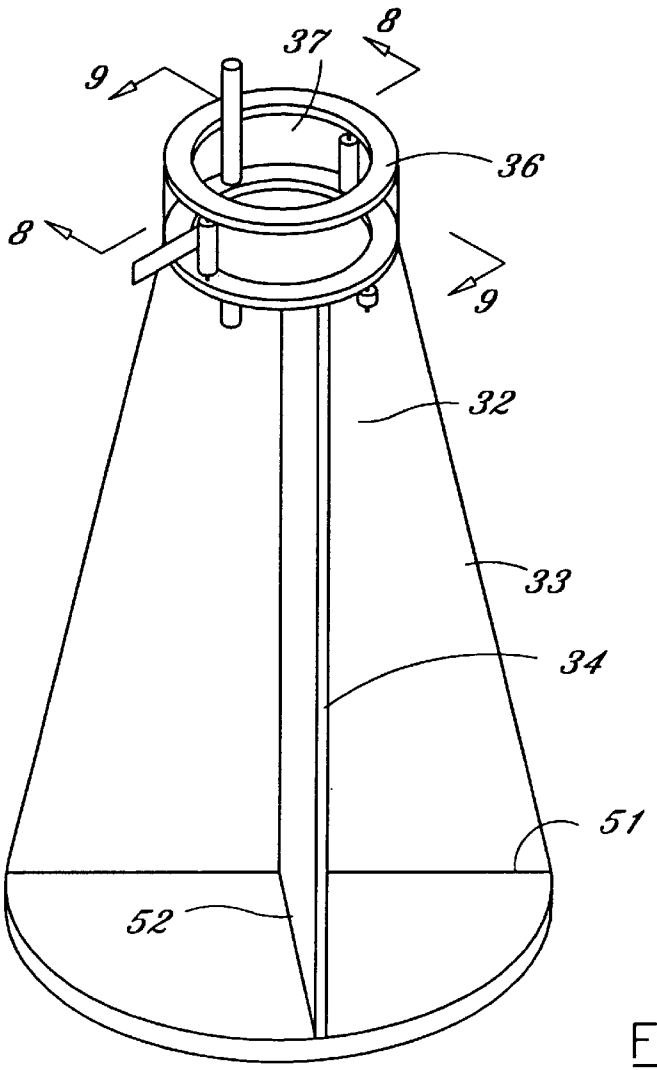
FIG. 7 is a perspective view of another embodiment of the invention.
Figure 9:
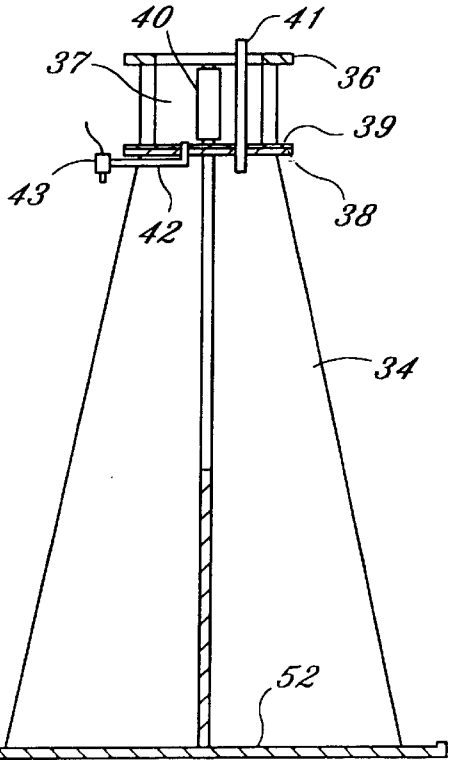
FIG. 9 is a sectional view taken through line 9—9 of FIG. 7.
Figure 8:
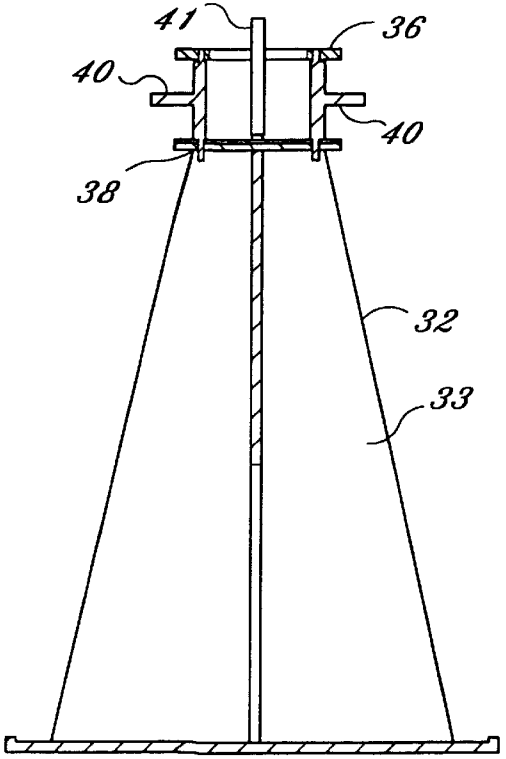
FIG. 8 is a sectional view taken through line 8—8 of FIG. 7.

Referring now to FIGS. 7–9, another embodiment of the apparatus is shown , in which the column 32 is formed from intersecting plates.

A first elongate tapered plate 33 with slot at the top and a second elongate tapered plate 34 with a slot at the bottom are interdigitated, cemented together, and cemented to base 35. Each plate has an inner top portion cut away to form, in cooperation with top annulus 36 a passage 37 to receive the neck of a container. A barrier 38 closes off the bottom of the passage. It rests on the plates and is strong enough to support the weight of the inverted container. A resilient sealing means 39 on the barrier seals off the mouth of the container. Cam levers 40 pivotally mounted in top annulus 36 and barrier 38 clamp the neck of the container to the apparatus. Vent tube 41 passes through and is sealed to resilient sealing means 39. Dispensing tube 42 passes through and is sealed to sealing means 39 and extends downwardly and laterally to terminate in a spring-loaded dispensing valve 43 of the type used on coffee machines. It is clear of obstructions so that a large receptacle may be placed beneath it.

Alternatively, the broad bottoms 51, 52 of the plates 33, 34 may function as the broad base and base 35 may be eliminated.

Figure 11:
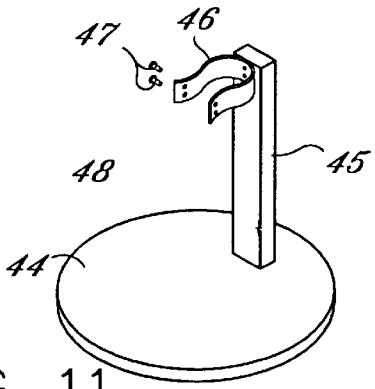
FIG. 11 is a perspective view of another embodiment of the invention.
Figure 12:
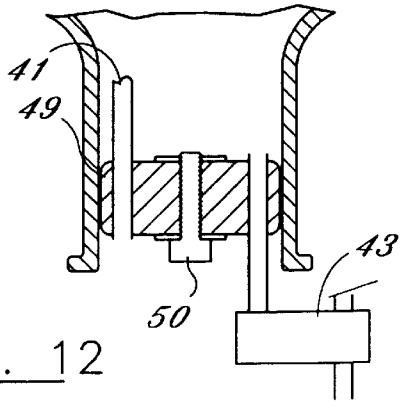
FIG. 12 is a sectional view through a seal for use with the support of FIG. 11.

Referring now to FIGS. 11, 12, another embodiment of the invention comprises a broad base 44 supporting a vertical post 45. A clamp 46 attached to the free end of post 45 clamps onto the neck of an upright liquid container with bolts 47. A projection 48 extending laterally from post or column 45 engages the mouth of the container. A rubber sealing plug 49 is inserted through the mouth of container and expanded by rotating threaded element 50 to seal the plug within the mouth. When the plug is sealed in place and the neck is clamped to the post, the bottle is then inverted as described above for the other embodiments.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

What is claimed is:

1. Liquid dispensing apparatus for dispensing liquid from an inverted container having a mouth through which liquid is discharged, and a neck, the apparatus comprising:

a broad base with an outer edge;

an elongate column upstanding from the base, the column having a first end affixed to the base and a free second end with a passage therein, the passage being dimensioned to receive therein the neck of an inverted liquid container, the passage having a transverse barrier at the bottom thereof;

a resilient sealing means on the barrier for sealingly engaging the open mouth of the container that has been received in the passage;

clamping means attached to the column adjacent the second end for removably clamping the neck of the container while the mouth of the container is sealed against the resilient sealing means;

an elongate vent tube having a first terminus passing through the sealing means and open to the atmosphere, and a second terminus above the column;

a check valve means for admitting air to the container when it is emptying and to prevent passage of liquid down through the vent tube affixed to the second terminus, a dispensing tube having a first tube end passing through the barrier and in fluid communication with the mouth of the container, the dispensing tube extending downwardly from the barrier and terminating in a valve means for controlled dispensing of the liquid from the inverted container; and the apparatus, when clamped onto an upright filled liquid container, enabling the container in combination with the apparatus to be turned onto its side and then inverted by pivoting about the outer edge without loss of liquid and with reduced lifting effort.

2. The apparatus according to claim 1, in which the vent tube is adapted to extend to approximately the container bottom.

3. The apparatus according to claim 2, in which the valve means is spring loaded.

4. The apparatus according to claim 1, in which the valve means is spring loaded.

5. The apparatus according to claim 4, in which the clamping means comprises cam levers.

6. The apparatus according to claim 1, in which the clamping means comprises cam levers.

7. The apparatus according to claim 1, in which the clamping means comprises threaded elements.

8. The apparatus according to claim 4, in which the clamping means comprises threaded elements.

9. Liquid dispensing apparatus for dispensing liquid from an inverted container having a mouth through which liquid is discharged, and a neck, the apparatus comprising:

a broad base with an outer edge;

an elongate column upstanding from the base, the column having a first end affixed to the base and a free second end with a passage therein, the passage being dimensioned to receive therein the neck of an inverted liquid container, the passage having a transverse barrier at the bottom thereof;

a resilient sealing means on the barrier for sealingly engaging the open mouth of the container that has been received in the passage;

clamping means attached to the column adjacent the second end for removably clamping the neck of the container while the mouth of the container is sealed against the resilient sealing means;

an elongate vent tube having a first terminus passing through the sealing means and open to the atmosphere, and a second terminus above the column;

a dispensing tube having a first tube end passing through the barrier and in fluid communication with the mouth of the container, the dispensing tube extending downwardly from the barrier and terminating in a valve means for controlled dispensing of the liquid from the inverted container; and the apparatus, when clamped onto an upright filled liquid container, enabling the container in combination with the apparatus to be turned onto its side and then inverted by pivoting about the outer edge without loss of liquid and with reduced lifting effort.

10. A method for mounting a filled liquid container in a suspended inverted position for gravity dispensing, comprising the steps of:

A) uncovering the mouth of the filled upright container;

B) providing an apparatus comprising:

a broad base with an outer edge;

an elongate column upstanding from the base, the column having a first end affixed to the base and a free second end with a passage therein, the passage being dimensioned to receive therein the neck of an inverted liquid container, the passage having a transverse barrier at the bottom thereof;

a resilient sealing means on the barrier for sealingly engaging the open mouth of the container that has been received in the passage;

clamping means attached to the column adjacent the second end for removably clamping the neck of the container while the mouth of the container is sealed against the resilient sealing means;

an elongate vent tube having a first terminus passing through the sealing means and open to the atmosphere, and a second terminus above the column; and a dispensing tube having a first tube end passing through the barrier and in fluid communication with the mouth of the container, the dispensing tube extending downwardly from the barrier and terminating in a valve means for controlled dispensing of the liquid from the inverted container;

C) inverting the apparatus and sliding the passage over the neck of the container so that the resilient sealing means engages the mouth of the container;

D) clamping the column to the container neck with the clamping means;

E) tilting the container onto its side by pivoting on the container bottom; and

F) tilting the combined apparatus and container by pivoting on the outer edge until the bottle is inverted.

11. Liquid dispensing apparatus for dispensing liquid from an inverted container having a mouth through which liquid is discharged, and a neck, the apparatus comprising:

a broad base with an outer edge;

an elongate column upstanding from the base, the column having a first end affixed to the base and a free second end;

clamping means attached to the column adjacent the second end for removably clamping the neck of the container while the container is upright;

a resilient sealing means for liquid-tight sealing of the mouth of the container when it is supported in inverted position by the clamping means;

an elongate vent tube having a first terminus passing through the sealing means and open to the atmosphere, and a second terminus above the column;

a dispensing tube having a first tube end passing through the sealing means and in fluid communication with the container, the dispensing tube extending downwardly from the sealing means and terminating in a valve means for controlled dispensing of the liquid from the inverted container; and the apparatus, when clamped onto an upright filled liquid container, enabling the container in combination with the apparatus to be turned onto its side and then inverted by pivoting about the outer edge without loss of liquid and with reduced lifting effort.

12. A method for mounting a filled liquid container in a suspended inverted position for gravity dispensing, comprising the steps of:

A) uncovering the mouth of the filled upright container,

B) providing an apparatus comprising:

a broad base with an outer edge;

an elongate column upstanding from the base, the column having a first end affixed to the base and a free second end;

clamping means attached to the column adjacent the second end for removably clamping the neck of the-container while the container is upright;

a resilient sealing means for liquid-tight sealing of the mouth of the container when it is supported in inverted position by the clamping means;

an elongate vent tube having a first terminus passing through the sealing means and open to the atmosphere, and a second terminus above the column;

a dispensing tube having a first tube end passing through the sealing means and in fluid communication with the container, the dispensing tube extending downwardly from the sealing means and terminating in a valve means for controlled dispensing of the liquid from the inverted container;

C) inverting the apparatus;

D) sealing the resilient sealing means to the mouth of the container;

E) clamping the column to the neck of the container with the clamping means;

F) tilting the container onto its side by pivoting on the container bottom; and

G) tilting the combined apparatus and container by pivoting on the the outer edge until the bottle is moved from lying on its side to the inverted position.

* * * * *